US007946354B2

(12) United States Patent
Elmqvist

(10) Patent No.: US 7,946,354 B2
(45) Date of Patent: May 24, 2011

(54) PNEUMATIC POWER TOOL WITH AIR COOLING SYSTEM

(75) Inventor: Karl Stefan Elmqvist, Upplands Väsby (SE)

(73) Assignee: Atlas Copco Tools AB, Nacka (SE)

( * ) Notice: Subject to any disclaimer, the term of this patent is extended or adjusted under 35 U.S.C. 154(b) by 60 days.

(21) Appl. No.: 12/517,153

(22) PCT Filed: Nov. 30, 2007

(86) PCT No.: PCT/SE2007/001062

§ 371 (c)(1),
(2), (4) Date: Jun. 1, 2009

(87) PCT Pub. No.: WO2008/066461

PCT Pub. Date: Jun. 5, 2008

(65) Prior Publication Data

US 2010/0071926 A1 Mar. 25, 2010

(30) Foreign Application Priority Data

Dec. 1, 2006 (SE) ..... 0602575

(51) Int. Cl.
*E21B 19/16* (2006.01)

(52) U.S. Cl. ..... 173/218; 173/216; 173/72; 173/199

(58) Field of Classification Search ..... 173/216, 173/218, 72, 199
See application file for complete search history.

(56) References Cited

U.S. PATENT DOCUMENTS 6,059,049 A * 5/2000 Lin ..... 173/93.5
(Continued)

FOREIGN PATENT DOCUMENTS

DE 19600339 C1 12/1996
(Continued)

OTHER PUBLICATIONS

English Language International Search Report dated Feb. 14, 2008 issued in parent Appln. No. PCT/SE2007/001062.

*Primary Examiner* — Brian D Nash
(74) *Attorney, Agent, or Firm* — Holtz, Holtz, Goodman & Chick, PC

(57) ABSTRACT

A pneumatic air tool includes a housing with a forward angle gearing arranged in a gearing chamber, a motor chamber, a rear air outlet section and a forward air outlet section. The motor chamber includes a pneumatic motor with air communication openings, which communicate with both the rear air outlet section, and the forward air outlet section. A part of the outlet air is ducted through the forward air outlet section including a circular groove in the housing which form part of a cooling chamber. The walls of the groove form together an enlarged heat transferring surface by which the heat generated in the angle gearing is efficiently transferred to the cold exhaust air from the motor passing through the cooling chamber. By communicating exhaust air through the cooling chamber there is obtained an efficient cooling of the angle gearing while maintaining favorable outer dimensions of the housing.

16 Claims, 3 Drawing Sheets

U.S. PATENT DOCUMENTS

| | | | | |
|---|---|---|---|---|
| 6,161,627 | A * | 12/2000 | Seith et al. | 173/93.5 |
| 6,464,018 | B1 * | 10/2002 | Uhl | 173/162.2 |
| 6,543,549 | B1 | 4/2003 | Riedl et al. | |
| 6,935,437 | B2 * | 8/2005 | Izumisawa | 173/93 |
| 6,988,565 | B2 * | 1/2006 | Giardino | 173/176 |
| 7,040,414 | B1 * | 5/2006 | Kuo | 173/179 |
| 7,354,260 | B1 * | 4/2008 | Chang | 418/270 |
| 7,398,836 | B2 * | 7/2008 | Elmvist et al. | 173/218 |
| 2005/0028997 | A1 * | 2/2005 | Hagan et al. | 173/178 |
| 2006/0225905 | A1 * | 10/2006 | Elmvist et al. | 173/197 |
| 2007/0056759 | A1 | 3/2007 | Aeberhard | |
| 2008/0066941 | A1 * | 3/2008 | Kobayashi | 173/218 |
| 2008/0073097 | A1 * | 3/2008 | Chen | 173/218 |

FOREIGN PATENT DOCUMENTS

| | | |
|---|---|---|
| JP | 2002-029974 A | 1/2002 |

* cited by examiner

PNEUMATIC POWER TOOL WITH AIR COOLING SYSTEM

This application is a U.S. National Phase Application under 35 USC 371 of International Application PCT/SE2007/001062 filed Nov. 30, 2007.

This invention relates to pneumatically powered tools for abrasive or fastening related work.

In particular, the invention concerns a pneumatic power tool which comprises a tool housing including a forward angle gear arrangement, a rearward motor chamber including a pneumatic motor, air inlet and outlet passages extending from the rear end of the tool, and an air outlet at the forward end of the tool.

BACKGROUND OF THE INVENTION

The combination of minimal tool exterior body area and demand for increased maximum torque/power deliverance sets high demand on the angle gear. In tools of the above type, there is always a problem to obtain an efficient enough cooling of the gearing or angle gear, due to heat generated during operation of the tool. Excessive heat in the gearbox is not allowed for large continuous rating. Problems that normally can occur are related to oil leakage due to excessive heat combined with wear of seals of the outgoing tool shaft. Especially tools with an outgoing shaft rpm exceeding 12000 rpm, having a very high periphery seal contact speed; it is found that both angle gear and seals are overheated in applications where the tool is continuously used. The primary problem to be solved is to minimise the temperature of the angle gearing during operation of the power tool. A secondary problem is to seal the angle gear and improve lubrication possibilities by minimising lubricant leakage due to wear of seals at the outgoing tool shaft.

A previously known way of solving heat problems is to use the cold exhaust air from the air motor to transport heat from for instance an impulse generator to the outside of the tool housing. An example on that is illustrated in U.S. Pat. No. 4,418,764. The tool shown in this patent is of the pistol handle type in which the housing is formed with an exhaust air passage that extends from the motor, past the impulse generator and out into the atmosphere via outlet openings at the forward end of the tool housing. The exhaust passage extends from a number of outlet openings on the motor cylinder and through cavities formed in the housing it has been easy just to design the casting of the housing to comprise the space necessary to accomplish a desired exhaust air flow.

Another known way of solving the heat problem is disclosed in U.S. Pat. No. 5,626,198, where a pneumatically powered torque impulse delivering tool for screw joint tightening comprises a housing with a forward impulse chamber enclosing a hydraulic impulse generator with air inlet and outlet passages located at the rear end of the housing. The motor cylinder is provided with radial air communication openings and outer grooves forming passages for connecting the openings to the air inlet and outlet passages. The exhaust air leaving the motor is ducted to the air outlet via rearward extending grooves, whereas part of the outlet air is communicated into the impulse chamber via forwardly extending grooves. From there on the exhaust air is ducted to the rear end of the motor and to the rear outlet passage. During its circulation through the impulse chamber, the cold exhaust air absorbs heat from the impulse generator and transports that heat out of the tool. With these types of machines circulation around the impulse chamber is easily obtained due to the fact that impulse chambers are tightly sealed. The impulse generator has its own internal lubrication and there is no desire for a forward exhaust outlet.

In the type of tools comprising an angle gear, however, i.e. angle grinders, the outer diameter of the tool housing has to be kept relatively small to offer a comfortable grip for the operator. When in such tools it also becomes desirable to arrange cooling air flow not only to and from openings in the motor cylinder to an exhaust passage at the rear end of the tool, but also past the angle gear and to an exhaust passage at the forward end of the tool. The problem is to obtain passages that do not interfere or enter the gear chamber but still have sufficient cooling effect.

SUMMARY OF THE INVENTION

The object of the invention is to accomplish an improved pneumatic torque/power delivering tool in which air communication passages to, from and past the air motor and angle gear provide not only large enough flow areas for cooling but an optimum motor size in relation to the outer diameter of the tool housing. Another objective of the invention is to seal the gear chamber from exhaust air and thereby enabling durable lubrication possibilities which extends the lifetime of the tool. Another objective is to protect the ball bearings of the output tool shaft against overheating.

A preferred embodiment of the invention is described below with reference to the accompanying drawings.

DESCRIPTION OF THE PREFERRED EMBODIMENT

Figure 1:
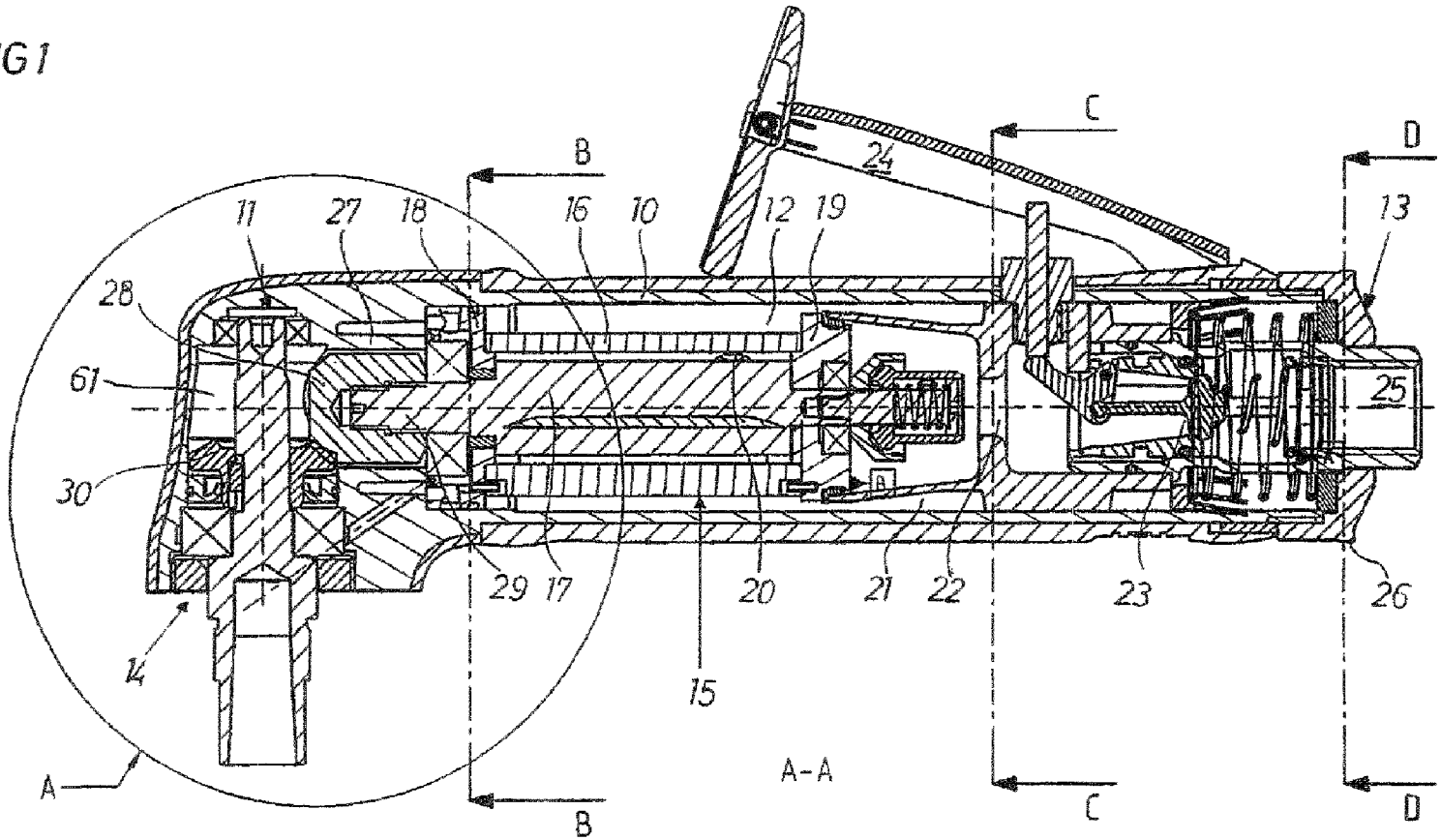
FIG. 1 shows a longitudinal section of a pneumatic power tool according to the invention.

The tool shown in FIG. 1 comprises a housing 10 with a forward angle gear arrangement or angle gearing 11, a motor chamber 12, a rearward air outlet or exhaust section 13 and a forward air outlet or exhaust section 14.

The motor chamber 12 comprises a vane type rotation motor 15, including a cylinder 16 and a rotor 17. The motor is rigidly secured in the housing 10 and has a forward end wall 18 and a rearward end wall 19, which both are adapted to enable air passage. At its forward end, the rotor 17 is drivingly connected to the angle gearing 11. The motor cylinder 16 comprises a number of (radial) air communication openings which act as motor outlet openings 20. The outlet openings 20 communicate with both the rear part of the tool via rearward exhaust section 13 and with forward part of the tool via the forward exhaust section 14. The motor is of a conventional design, and since it is not in itself a part of the invention it is not described in further detail.

The motor chamber 12 has rearward air exhaust passages 21 and a rear air inlet passage 22, a throttle valve 23 operable by a lever 24 and at least two outlet openings 20 in cylinder 16. The rear end of the tool is provided with a central tubular connection member 25 for connection of a pressure air conduit. The connection member 25 is encircled by a rearward outlet passage 21, and the rear end of the tool housing 10 is formed with an external socket portion 26 for connection of an outlet duct, if desired. The outlet passages are defined either by grooves formed, for instance by milling, on the outer surface of the cylinder 16, the inner surface of the housing 10 and/or by adapting the details for enabling air communication.

Figure 2:
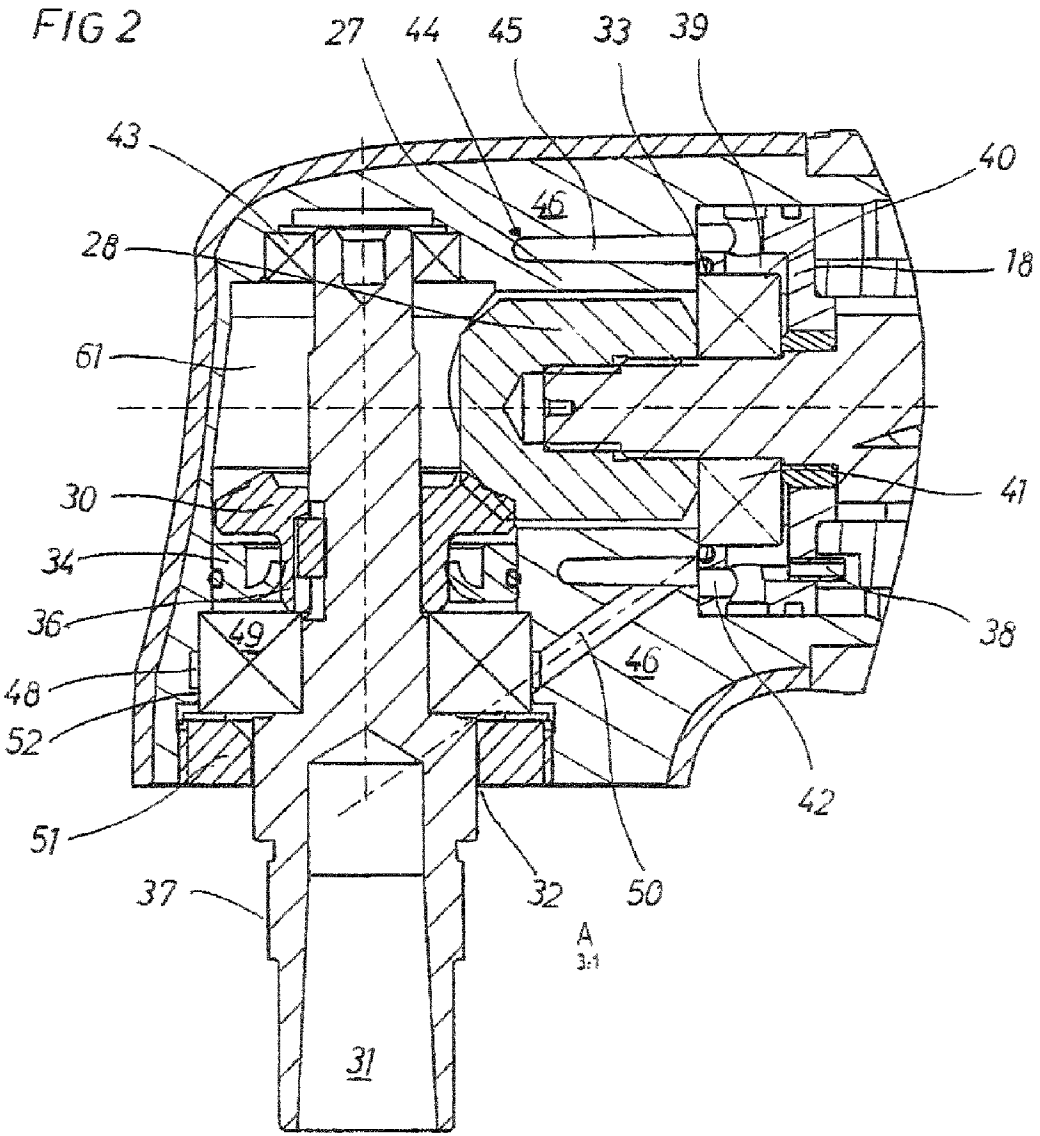
FIG. 2 shows a longitudinal section A of the angle gearing with scale 3:1.
Figure 3:
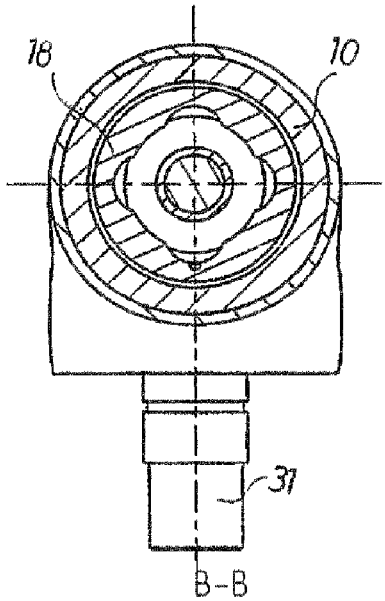
FIG. 3 shows a cross section of the motor forward end wall along line B-B.
Figure 4:
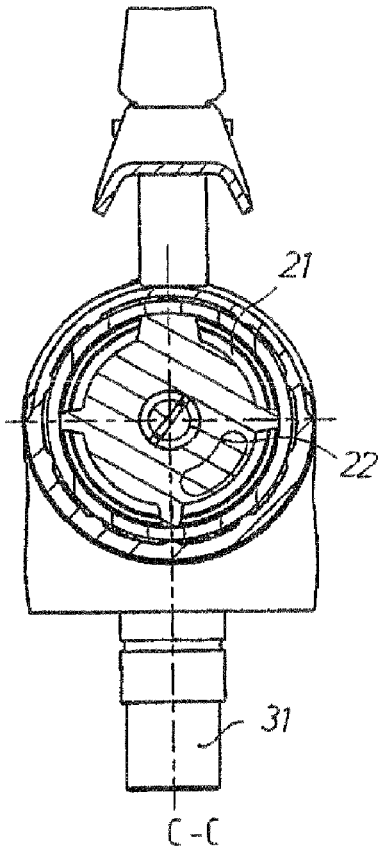
FIG. 4 shows a cross section of the motor rear end comprising air passages along line C-C.
Figure 5:
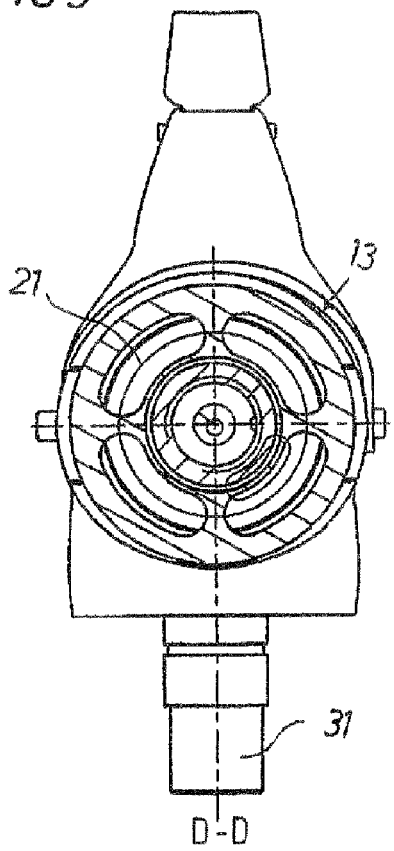
FIG. 5 shows a cross section of the rear end of the tool along line D-D.

The angle gearing 11, in FIG. 2, is supported and located in a gearing chamber 61. The angle gearing 11 comprises a pinion 28 that is fixedly arranged on the forward end of the rotor shaft 29 which is supported by a sealed ball bearing 19. The angle gearing 11 further comprises a bevel gear 30 which interacts with said pinion 28 and is mounted on an output shaft 31 extending out of the housing 10 through a front opening which also provides an auxiliary outlet passage 32. The output shaft 31 is supported in the housing by two ball bearings 43 and 49. The gearing chamber 61 is sealed by means of a seal ring 33, provided in the forward end wall 18 and with a resilient contact seal 34, which seals on the gear mantel 36 or directly on the output shaft 31. The seal 34 can be of other radial type. Said seal ring 33 prevents pressurised air from entering the gearing chamber 61 while the contact seal 34 prevents lubricant leakage. The output shaft 31 has a threaded section 37 for enabling mounting of different kinds of tools.

The pressure air supplied via the valve 23 is ducted to the pneumatic motor 15 and the exhaust air leaving the motor through the air communication openings 20 is primarily, ducted rearwardly via passages 21 to the rearward exhaust section 13. The part of the outlet air that is forwardly ducted will be described in detail since this part does involve the characteristics of the claimed invention. Part of the exhaust air leaving the motor through the openings 20, is ducted forwardly through the passages provided between the motor cylinder 16 and the housing 10 and through at least one passage 38 forming a small area portion in the for the purpose adapted forward end wall 18. The forward end wall 18 further comprises a circumferential duct 39 partly around the outer ring 40 of a sealed bearing 41, to enable heat transfer from the bearing to the passing exhaust air. A set of air passages 42 are arranged facing a cooling chamber 44 which enable air to flow into said cooling chamber 44. In the housing 10 there is provided a circular groove 45 which forms a part of a cooling chamber 44 and which leaves an annular flange 27 extending axially in a close relation to the pinion 28 and forming a partition wall 27 between the cooling chamber 44 and the gearing chamber 61. The end surface of the annular flange co-operates with the forward motor end wall 18 via a seal ring 33 so as to prevent leakage of exhaust air into the gearing chamber 61. The walls of the groove 45 form together an enlarged heat transferring surface by which the heat generated in the gearing is efficiently transferred to the cold exhaust air from the motor passing through the cooling chamber 44. The groove 45 can also be produced by means of milling or other processes. The cooling chamber 44 has one outer wall 46 extending towards the tool exterior periphery while the partition wall 27, has a lesser thickness and extends towards the gearing chamber 61 and which form is adapted to the outer periphery of the pinion 20. The partition wall 27 may have different shapes, the task of this wall is to provide a heat transferring surface as to increase the air contact area to increase heat transfer from the gearing chamber 61 to the passing exhaust air.

The cooling chamber 44 is furthermore sealed off relative to the gearing chamber but communicates on one hand with the exhaust passage 38 on the other hand with the atmosphere to form part of an auxiliary outlet passage 32.The cooling chamber 44 is sealed with a seal ring 33 provided in the motor forward end wall 18. The cooling chamber 44 is an integrated part of the tool housing, which advantageously is provided in cast aluminium and/or machined aluminium or other light alloy for better heat conducting properties. Pressure in the gearbox could in many cases lead to oil leakage through the sealing member at the output shaft. The exhaust air leaving the motor through the air communication openings 20 is primarily, with a volume percentage between 95-99%, ducted rearwardly via passages 21 to the rearward exhaust section 13 while consequently a volume percentage of 1-5% of said exhaust air is ducted forwardly.

The angle gearing comprises furthermore a cooling passage 48 of the output shaft 31, ball bearings 43, 49 and the seal 34. The cooling chamber 44 communicates via a channel 50 with a cooling passage 48. The housing 10 has a milled groove 51 that together with the bearing outer ring 52 forms a circumferential duct 51 around the bearing. By communicating the cold exhaust air from the cooling chamber 44 trough the channel 50 into the duct the bearing is enabled to transfers heat from the bearing to the air. The housing 10, the output shaft 31, and indirectly the seal 34 is cooled due to this heat transfer. The exhaust air is further ducted to the atmosphere via an annular gap 32 between the output shaft and a locking nut 53.

In operation of the tool, a pressure air conduit is connected to the connection member 25 for supplying motive pressure air to the motor 15, and an abrasive pad is attached to the output shaft 31 for abrasive operations. The tool housing 10 is grasped by the operator and the throttle valve 23 is opened by pressing the lever 24. The motor 15 starts rotating thereby delivering rotation power to the angle gearing 11. The expanding cool exhaust air from the motor is enabled to circulate through the cooling chamber 44 over the heat transferring surface 27 and is then ducted through a channel 50 provided in the tool housing and which extends from said chamber 44 and communicates with a milled groove 51 that circumvents an axial bearing 49 of the output shaft 31. The groove 51 is so adapted as to ventilate the exhaust air cross the bearing surface. The exhaust air absorbs heat from the bearing and output shaft and is further ducted out of the tool between the annular space or gap of output shaft 31 and a locking member 53. During this circulation through the cooling chambers (44, 48), the cold exhaust air absorbs heat from the angle gearing 11 and transports that heat out of the tool.

By forming the air communication passages on the outer surface of the motor cylinder 20 into a sealed cooling chamber it is possible to obtain sufficient cooling of the angle gear arrangement while maintaining favourable dimensions of the housing and the motor.

The invention claimed is:

1. A pneumatic power tool, comprising:

a housing;

a motor;

an output shaft and a gearing connecting the motor to the output shaft;

a pressure air inlet passage and an air outlet passage arranged in the housing which communicate air to and from, respectively, the motor; and a cooling chamber provided between the motor and the partition wall, said cooling chamber being sealed off relative to the gearing chamber and communicating with the atmosphere via an auxiliary outlet passage;

wherein the gearing is located in a gearing chamber partly defined by a partition wall in the housing, said partition wall providing a heat transferring surface which is exposed to the cooling chamber and cold exhaust air passing through said cooling chamber, thereby transferring heat from the gearing chamber;

wherein said heat transferring surface comprises walls of at least one groove formed in the housing for increasing the heat transferring efficiency; and wherein a tubular section formed by a circular groove in the housing forms part of the walls of the heat transferring surface exposed to the cooling chamber.

2. A pneumatic power tool according to claim 1, wherein said auxiliary outlet passage comprises at least one small area portion adapted to let through less than ten percent of the total exhaust air from the motor.

3. A pneumatic power tool according to claim 2, wherein:

the gearing comprises an angle gearing having a pinion connected to the motor and a bevel gear connected to the output shaft; and said auxiliary outlet passage opens to the atmosphere through an annular gap surrounding the output shaft.

4. A pneumatic power tool according to claim 1, wherein said cooling chamber comprises an integrated part of the tool housing.

5. A pneumatic power tool according to claim 4, wherein a tubular section formed by a circular groove in the housing forms part of the walls of the heat transferring surface exposed to the cooling chamber.

6. A pneumatic power tool according to claim 1, wherein said housing comprises a light alloy for improved heat transfer.

7. A pneumatic power tool according to claim 1, wherein a resilient contact seal is provided around the output shaft to seal off the gearing chamber.

8. A pneumatic power tool according to claim 1, wherein:

the gearing comprises an angle gearing having a pinion connected to the motor and a bevel gear connected to the output shaft; and said auxiliary outlet passage opens to the atmosphere through an annular gap surrounding the output shaft.

9. A pneumatic power tool, comprising:

a housing;

a motor;

an output shaft and a gearing connecting the motor to the output shaft;

a pressure air inlet passage and an air outlet passage arranged in the housing which communicate air to and from, respectively, the motor; and a cooling chamber provided between the motor and the partition wall, said cooling chamber being sealed off relative to the gearing chamber and communicating with the atmosphere via an auxiliary outlet passage;

wherein the gearing is located in a gearing chamber partly defined by a partition wall in the housing, said partition wall providing a heat transferring surface which is exposed to the cooling chamber and cold exhaust air passing through said cooling chamber, thereby transferring heat from the gearing chamber; and wherein the output shaft is supported in a bearing and said housing comprises an auxiliary passage formed by a groove in the housing that together with a bearing outer ring forms a circumferential duct surrounding the bearing so as to enable heat transfer from said bearing to the passing exhaust air.

10. A pneumatic power tool according to claim 9, wherein:

the gearing comprises an angle gearing having a pinion connected to the motor and a bevel gear connected to the output shaft; and said auxiliary outlet passage opens to the atmosphere through an annular gap surrounding the output shaft.

11. A pneumatic power tool according to claim 9, wherein a tubular section formed by a circular groove in the housing forms part of the walls of the heat transferring surface exposed to the cooling chamber.

12. A pneumatic power tool, comprising:

a housing;

a motor;

an output shaft and a gearing connecting the motor to the output shaft;

a pressure air inlet passage and an air outlet passage arranged in the housing which communicate air to and from, respectively, the motor; and a cooling chamber provided between the motor and the partition wall, said cooling chamber being sealed off relative to the gearing chamber and communicating with the atmosphere via an auxiliary outlet passage;

wherein the gearing is located in a gearing chamber partly defined by a partition wall in the housing, said partition wall providing a heat transferring surface which is exposed to the cooling chamber and cold exhaust air passing through said cooling chamber, thereby transferring heat from the gearing chamber;

wherein the gearing comprises an angle gearing having a pinion connected to the motor and a bevel gear connected to the output shaft; and wherein said auxiliary outlet passage opens to the atmosphere through an annular gap surrounding the output shaft.

13. A pneumatic power tool according to claim 12, wherein the cooling chamber is circumferentially and coaxially arranged with respect to a longitudinal center axis of the pinion.

14. A pneumatic power tool according to claim 13, wherein the partition wall is defined by, and adjacently arranged to, an outer periphery of the pinion for increasing heat transfer from the gearing.

15. A pneumatic power tool according to claim 13, wherein a tubular section formed by a circular groove in the housing forms part of the walls of the heat transferring surface exposed to the cooling chamber.

16. A pneumatic power tool according to claim 12, wherein a tubular section formed by a circular groove in the housing forms part of the walls of the heat transferring surface exposed to the cooling chamber.

* * * * *